US007068228B2

(12) United States Patent
Soutome

(10) Patent No.: US 7,068,228 B2
(45) Date of Patent: Jun. 27, 2006

(54) ANTENNA ELEMENT AND MOBILE TELEPHONE DEVICE

(75) Inventor: Hideyuki Soutome, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/523,108

(22) PCT Filed: Jul. 4, 2003

(86) PCT No.: PCT/JP03/08543

§ 371 (c)(1),
(2), (4) Date: Feb. 3, 2005

(87) PCT Pub. No.: WO2005/004282

PCT Pub. Date: Jan. 13, 2005

(65) Prior Publication Data

US 2005/0259010 A1 Nov. 24, 2005

(51) Int. Cl.
*H01Q 1/24* (2006.01)

(52) U.S. Cl. ..... 343/702; 343/725; 343/895

(58) Field of Classification Search ..... 343/702, 343/725, 895

See application file for complete search history.

(56) References Cited

U.S. PATENT DOCUMENTS

| | | | | |
|---|---|---|---|---|
| 6,731,920 | B1 * | 5/2004 | Iwai et al. | 455/272 |
| 2003/0063036 | A1 * | 4/2003 | Sato et al. | 343/702 |
| 2004/0066341 | A1 * | 4/2004 | Ito et al. | 343/702 |
| 2005/0110692 | A1 * | 5/2005 | Andersson | 343/702 |

FOREIGN PATENT DOCUMENTS

| | | |
|---|---|---|
| JP | 62-034407 | 2/1987 |
| JP | 1999-261318 | 9/1999 |
| JP | 2002-171126 | 6/2002 |
| JP | 2003-008319 | 1/2003 |
| JP | 2003-087043 | 3/2003 |
| WO | 01/80367 | 10/2001 |
| WO | 02/13312 | 2/2002 |

* cited by examiner

*Primary Examiner*—Tan Ho
(74) *Attorney, Agent, or Firm*—Oblon, Spivak, McClelland, Maier & Neustadt, P.C.

(57) ABSTRACT

A monopole antenna and a plurality of linear antennas each having its own predetermined electrical length are connected with a plate antenna, which is connected with a grounding plate via a single feeding point thereof, in such a way that they are connected in series to the feeding point, thereby, each of the feeding points of the antennas is united in one single point; consequently, an antenna device having broad band characteristics and multiple resonance characteristics is obtained.

8 Claims, 9 Drawing Sheets

ANTENNA ELEMENT AND MOBILE TELEPHONE DEVICE

This application is a 371 of PCT/JP03/08543 filed on Jul. 4, 2003.

TECHNICAL FIELD

The present invention relates to antenna devices for portable telephones utilizing a plurality of frequency bands.

BACKGROUND ART

In conventional antennas for portable telephones, for example, monopole antennas and helical antennas are used. Among these configurations, a configuration in which antenna devices are directly contacted and connected with each other is disclosed in Japanese Laid-Open Patent Publication 261,318/1999.

In recent years, in shifting the portable telephone systems from PDC (personal digital cellular) to CDMA (code division multiple access), dual mode portable telephones have been developed, in which both the PDC and CDMA systems can be utilized. In these systems, although the electric wave frequency bands used for the transmission and reception are different from each other, in a case in which information communication is performed in a predetermined frequency band, the impedance must be matched in these frequency bands. Consequently, because the system is generally designed as a guide such that VSWR (voltage standing wave ratio) in the frequency band in use becomes at least three or less than three, it is necessary to design the system to have VSWR of three or less than three for each of the frequency bands in use. However, in antennas having conventional matching circuits, the regions in which VSWR is three or less than three have been too narrow to adjust them to use for portable information terminals having plural functions; therefore, they have been difficult to adjust.

Moreover, in the conventional antenna configuration of the portable telephones, when two or more than two frequency bands apart from each other are used, antenna devices corresponding to each frequency must be mounted; additional pins, springs, matching circuits, and antenna selecting switches, for feeding each antenna device, need to be provided.

However, regarding the portable telephones in recent years, end users tend to prefer thin-and-compact types; the increase in the packaging area due to a plurality of frequency bands being used, runs counter to the trends to reduce the thickness and size thereof; consequently, there has been a problem in that product competitiveness may be lost.

In addition, in a configuration in which a matching circuit is mounted on each of the antenna devices, coils and condensers used for the matching circuit cause losses; therefore, there has been a problem in that efficiency in the electrical-signal transmission decreases.

DISCLOSURE OF THE INVENTION

An objective of the present invention, which has been made to solve the foregoing problem, is to obtain an antenna, in which a unitary feeding point with respect to a plurality of antennas is provided onto a plate antenna, and a plurality of pole antennas is provided onto a side of the plate antenna, so that the decrease of the electrical-signal transmission efficiency and the increase of the packaging area can be prevented as much as possible, and VSWR being three or less than three can be realized in multiple frequency bands.

An antenna device according to the present invention includes: a plate antenna formed of a metal plate having a predetermined electrical length and connected via a feeding point thereof with a grounding plate; a monopole antenna being connected in series with the plate antenna with respect to the feeding point and having an electrical length different from the electrical length of the plate antenna; and a plurality of linear antennas being connected in series with the plate antenna with respect to the feeding point, each having an electrical length different from the other and different from both the electrical length of the plate antenna connected in parallel with the monopole antenna, and the length of the monopole antenna.

BEST MODE FOR CARRYING OUT THE INVENTION

Embodiment 1

Embodiment 1 according to the present invention will be explained. In the present invention, one point on a plate antenna is made to be a feeding point, and a pole antenna and linear antennas having a plurality of different electrical lengths are connected in series with respect to the feeding point, so that the decreasing of the electrical-signal transmission efficiency and the increasing of the packaging area of the antenna are prevented as much as possible; consequently, VSWR of three or less than three in a plurality of frequency bands can be realized.

Figure 1:
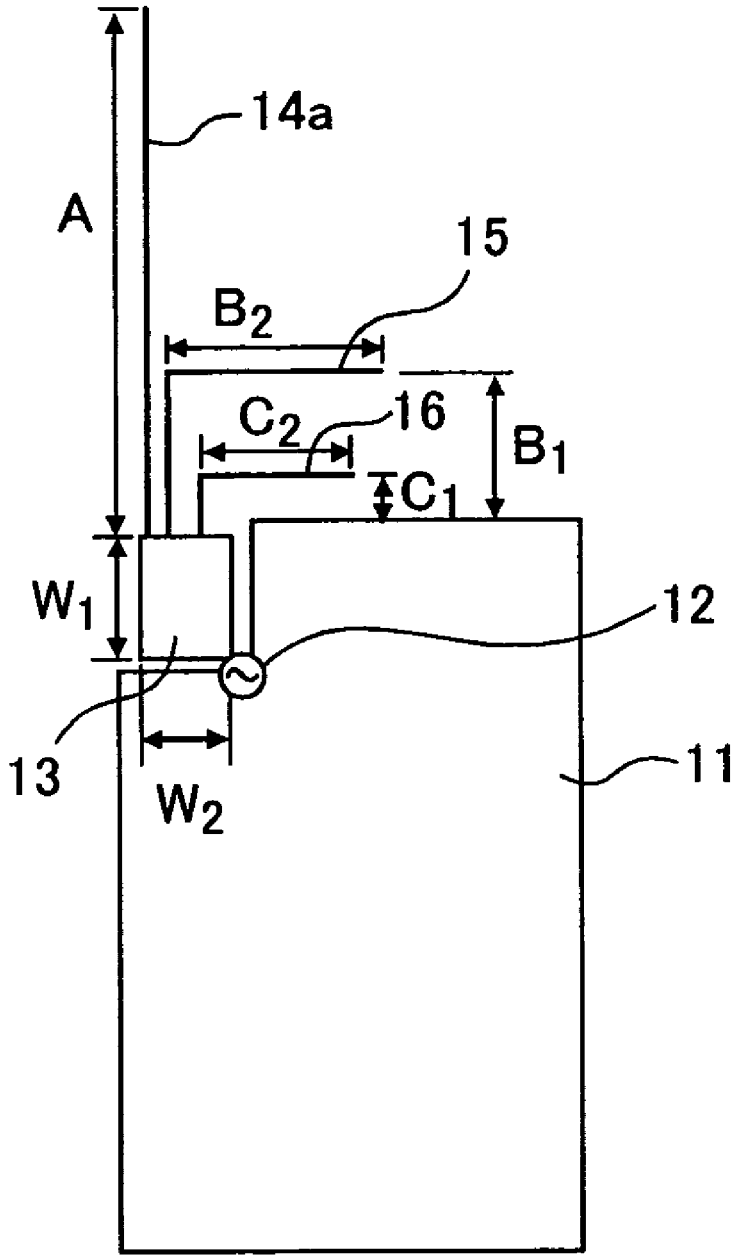
FIG. 1 is a plan view illustrating an antenna device according to Embodiment 1 of the present invention.
Figure 2:
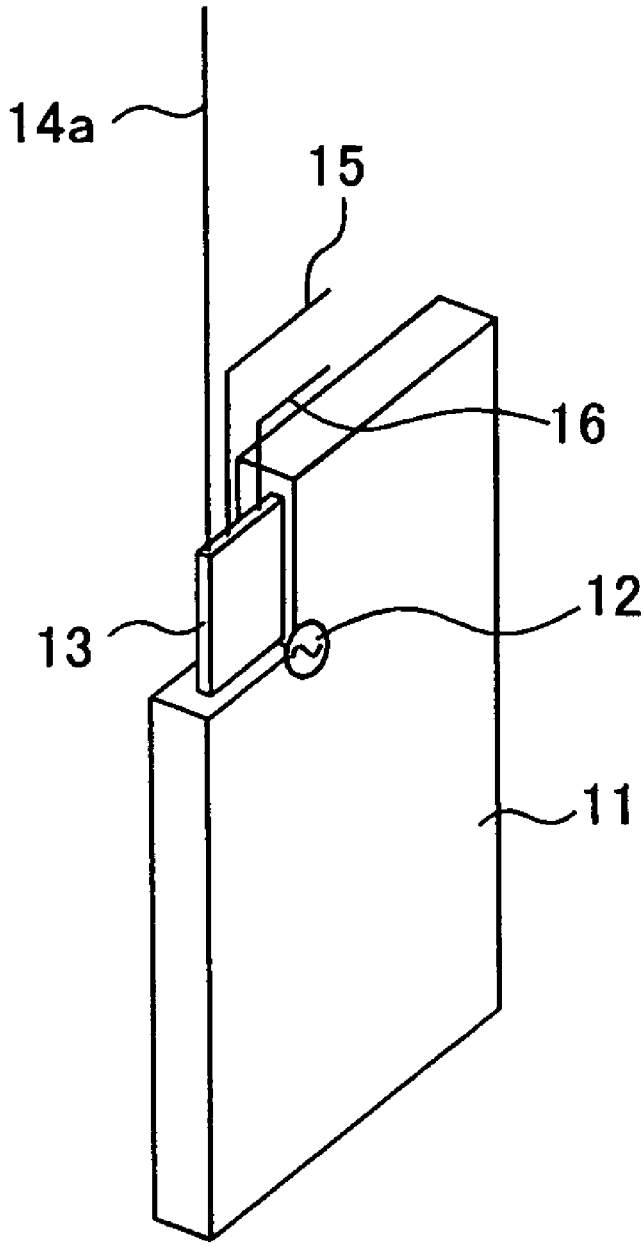
FIG. 2 is a perspective view illustrating the antenna device according to Embodiment 1 of the present invention.

FIG. 1 is a plan view illustrating an antenna device according to Embodiment 1 of the present invention, and FIG. 2 is its perspective view. In each figure, numeral 11 is a grounding plate formed of a metal (for example, copper) layer deposited on a predetermined insulation substrate. Numeral 13 is a plate antenna as a first antenna element, in which the electrical length in the 2 GHz band is approximately $\lambda_2/8$ ($\lambda_2$ is the electrical wavelength at 2 GHz, $\lambda_2$=15 cm). Here, the length and width of the plate antenna are set to $W_1$ and $W_2$, respectively, and the electrical length is adjusted to $\lambda_2/8$ (=1.875 cm)=$W_1+W_2$. Moreover, feeding is performed to a point 12 (hereinafter referred to as a feeding point) on an end of this plate antenna 13. Furthermore, the plate antenna 13 is also connected with the grounding plate 11 at the feeding point 12. On the plate antenna 13, being fed to the point, a monopole antenna 14*a*, whose electrical length is adjusted to $\lambda_{800}/4$ (=9.375 cm)=$W_1+W_2+A$ (symbol A is the length of the monopole antenna) in the 800 MHz band, is connected onto another end thereof other than the feeding point 12. Similarly, a linear antenna 15 whose electrical length in the 1.5 GHz band is adjusted to $\lambda_{1.5}/4$ (=5 cm)=$W_1+W_2+B_1+B_2$ ($B_1$ and $B_2$ are the length and width of the linear antenna 15, respectively), and a linear antenna 16 whose electrical length in the 2 GHz band is adjusted to $\lambda_2/4$ (=5 cm)=$W_1+W_2+C_1+C_2$ ($C_1$ and $C_2$ are the length and width of the linear antenna 16, respectively) are connected with the plate antenna 13, so as to be connected in series with respect to the feeding point 12. As the material used for the plate antenna 13, monopole antenna 14*a*, and linear antennas 15 and 16, for example, copper is used.

Figure 3:
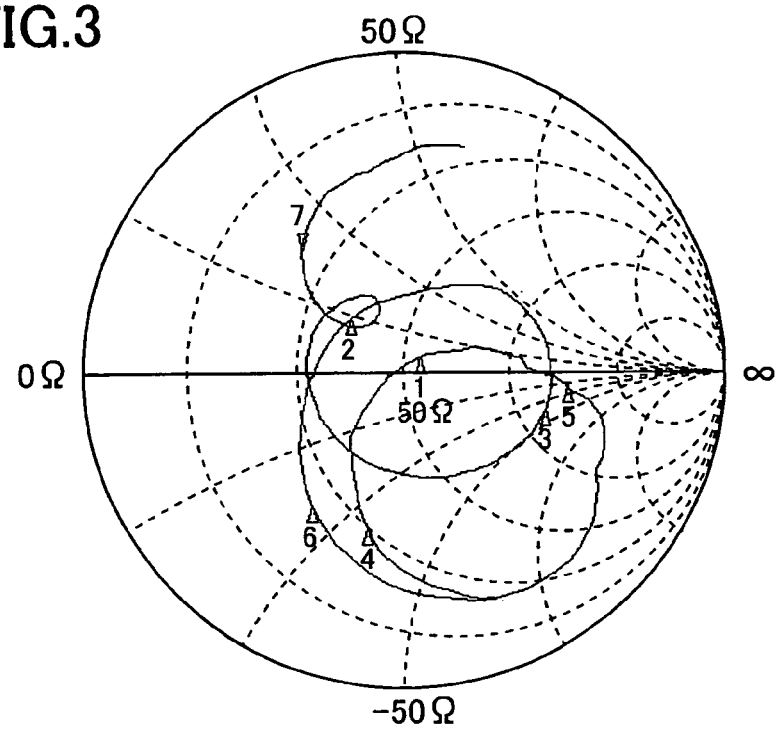
FIG. 3 is a Smith chart illustrating characteristics of the antenna device according to Embodiment 1 of the present invention.
Figure 4:
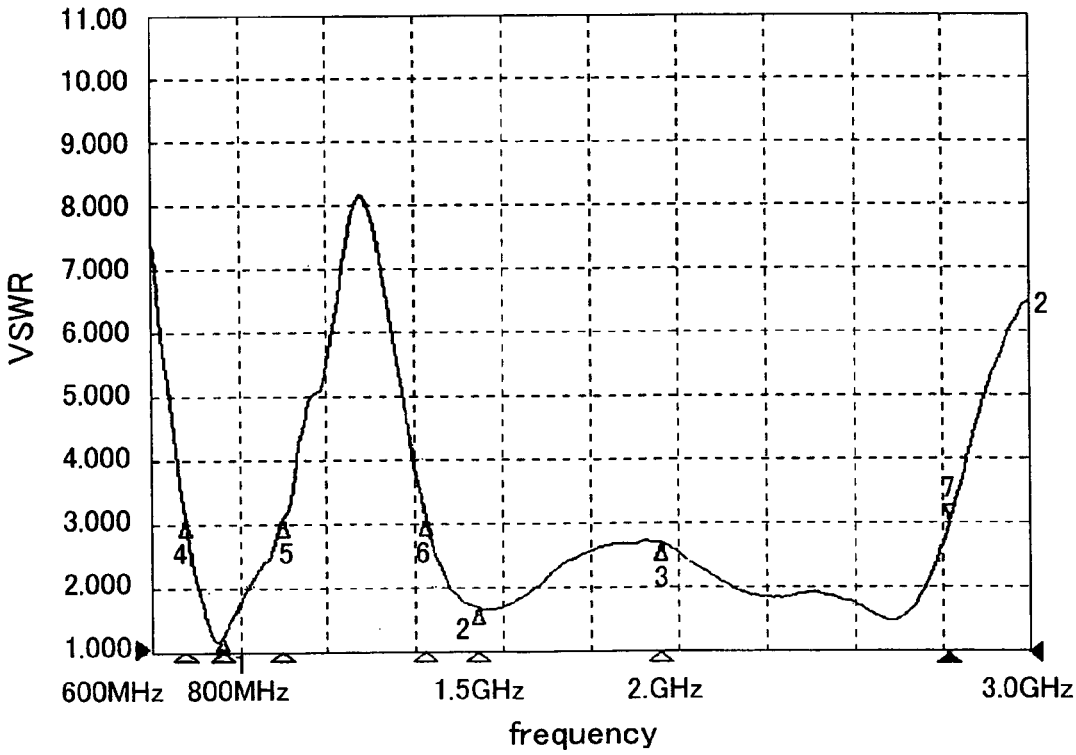
FIG. 4 is a VSWR chart illustrating characteristics of the antenna device according to Embodiment 1 of the present invention.

FIG. 3 is a Smith chart illustrating antenna characteristics of the configuration represented in FIG. 1, and FIG. 4 is its VSWR. The sizes of each antenna are set to:

the plate antenna 13 $W_1$: 10 mm, $W_2$: 5 mm;

the monopole antenna 14*a* A: 78 mm;

the first linear antenna 15 $B_1$: 4 mm, $B_2$: 26 mm;

the second linear antenna 16 $C_1$: 2 mm, $C_2$: 21 mm.

Figure 5:
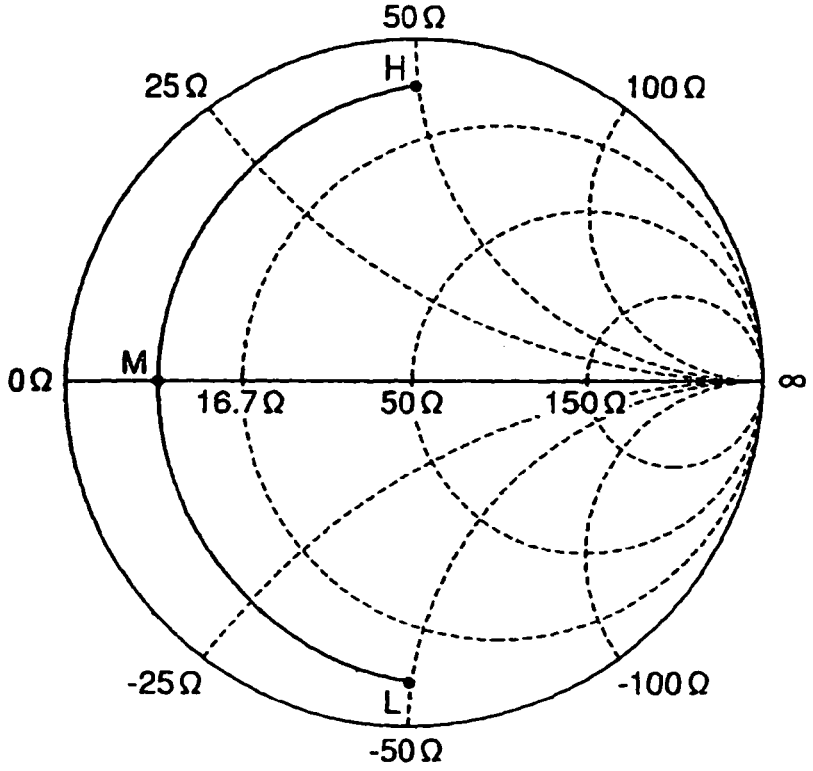
FIG. 5 is a Smith chart illustrating characteristics when only a plate antenna is used.

Before explaining on FIG. 3 and FIG. 4, the antenna characteristics of the plate antenna device and monopole antenna device will be explained for comparison. FIG. 5 is a Smith chart illustrating characteristics when only the plate antenna is used. As illustrated in FIG. 5, characteristics of the plate antenna 13 can be obtained in which half a circle is drawn with centering on the 50 Ω point, which is generally called as the reference impedance. In the higher frequency range than that around the resonant point, the imaginary part of the impedance becomes a positive value as represented by a point H; on the contrary, in the lower frequency range than that around the resonant point, the imaginary part of the impedance becomes a negative value as represented by a point L.

Figure 6:
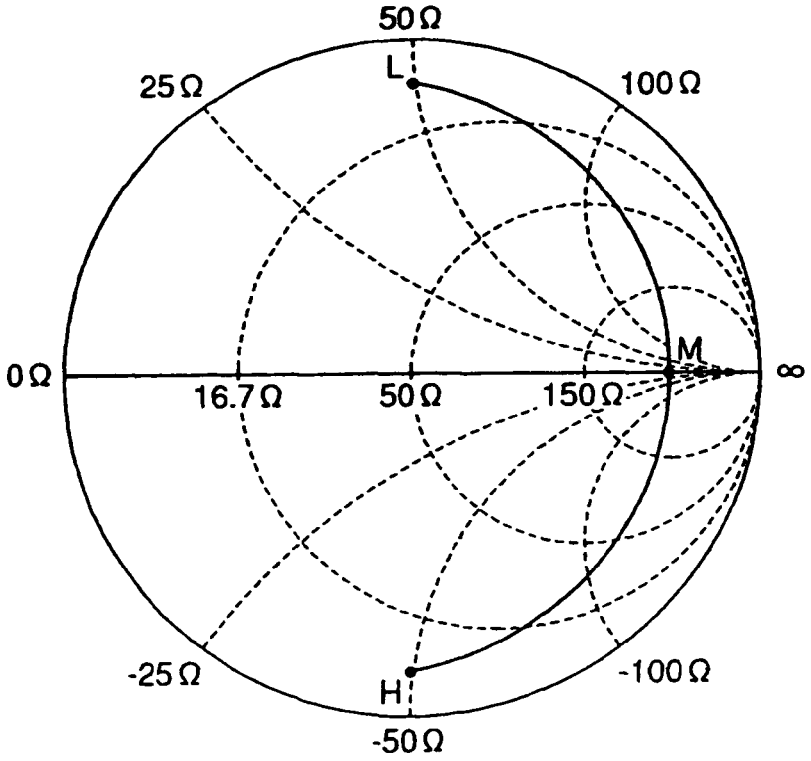
FIG. 6 is a Smith chart illustrating characteristics when only a monopole antenna is used.

Moreover, FIG. 6 is a Smith chart illustrating characteristics when only the monopole antenna is used. In the monopole antenna 14*a*, as illustrated in FIG. 6, the imaginary part of the impedance becomes a negative value in the higher frequency range than that around the resonant point as represented by the point H. On the contrary, in the lower frequency range than that around the resonant point, the imaginary part of the impedance becomes a positive value as represented by the point L.

In contrast to those behavior, in Embodiment 1 according to the present invention, regions in which the impedance locus approaches approximately 50 Ω, which is the center point, increase, as illustrated in the Smith chart of FIG. 3, comparing with FIG. 5 illustrating the case in which only the plate antenna 13 is used, or with FIG. 6 illustrating the case in which only the monopole antenna is used; consequently, the impedance turns out to be matched owing to the interaction of each antenna.

Moreover, as the VSWR-vs.-frequency characteristics illustrated in FIG. 4, regions in which VSWR becomes three or less than three spread at around 800 MHz and between 1.5–2.5 GHz; therefore, broader band characteristics and more multiple resonance characteristics than those in the conventional one can be found to be obtained. Regarding frequencies at points 1–7 in FIG. 3 and FIG. 4, point 1 corresponds to 800 MHz, point 2 to 1,500 MHz, point 3 to 2,000 MHz, point 4 to 696.5 MHz, point 5 to 962 MHz, point 6 to 1,356 MHz, and point 7 to 2,785 MHz, respectively.

Impedance and VSWR at predetermined frequencies are listed in Table 1.

TABLE 1

| Point | Frequency [MHz] | Impedance of antenna device [Ω] Real part [Ω] | Imaginary part [Ω] | VSWR |
|---|---|---|---|---|
| 1 | 800 | 54.906 | 6.124 | 1.198 |
| 2 | 1500 | 33.801 | 12.861 | 1.647 |
| 3 | 2000 | 121.91 | −33.224 | 2.662 |

In addition, relative band widths were calculated in FIG. 4; as a result, the relative band widths were 32% in the 800 MHz band, and 69% in the 1.5–2.0 GHz band. Here, the "relative band width" in this specification represents a relative band width in a region in which VSWR is three or less than three. Assuming that the highest frequency among frequencies in which VSWR≦3 is satisfied is $f_1$, and the lowest frequency among frequencies in which VSWR≦3 is satisfied is $f_2$, the center frequency $f_0$ is obtained from $$f_0=(f_1+f_2)/2$$

and the relative band width is obtained, using this center frequency, as follows;

$$\text{relative band width}=(f_1-f_2)/f_0$$

Figure 7:
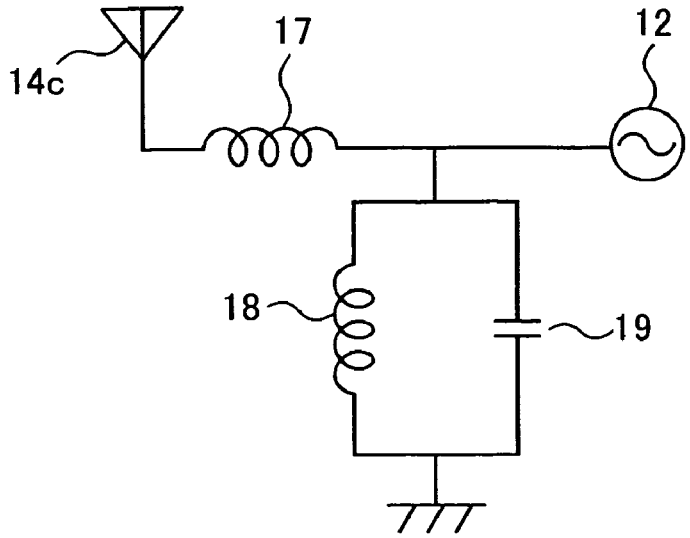
FIG. 7 is a view illustrating a configuration of a conventional antenna device.

For comparison, the relative band width in a conventional antenna device will be represented. FIG. 7 is a circuit diagram of the conventional antenna device. In FIG. 7, the antenna device is comprised of a monopole antenna 14*c*, a coil 17, a stub 18, and a condenser 19 being used. The coil 17 has an inductance of 6.8 nH. The condenser 19 has a capacitance of 4 pF. The monopole antenna 14*c* has a length of 55 mm (electrical length: 3λ/8). Electric waves having frequencies from 1.5 GHz to 2.5 GHz are inputted from the feeding point 12 into the antenna device having such a matching circuit, and the impedance, Smith chart, and VSWR of the antenna device have been investigated. The impedance and VSWR at predetermined points are listed in Table 2.

TABLE 2

| Point | Frequency [MHz] | Impedance of antenna device [Ω] Real part [Ω] | Imaginary part [Ω] | VSWR |
|---|---|---|---|---|
| 201 | 1920 | 58 | 0 | 1.2 |
| 202 | 1980 | 44 | 3 | 1.3 |
| 203 | 2110 | 48 | 14 | 1.4 |
| 204 | 2170 | 48 | −10 | 1.4 |

Figure 8:
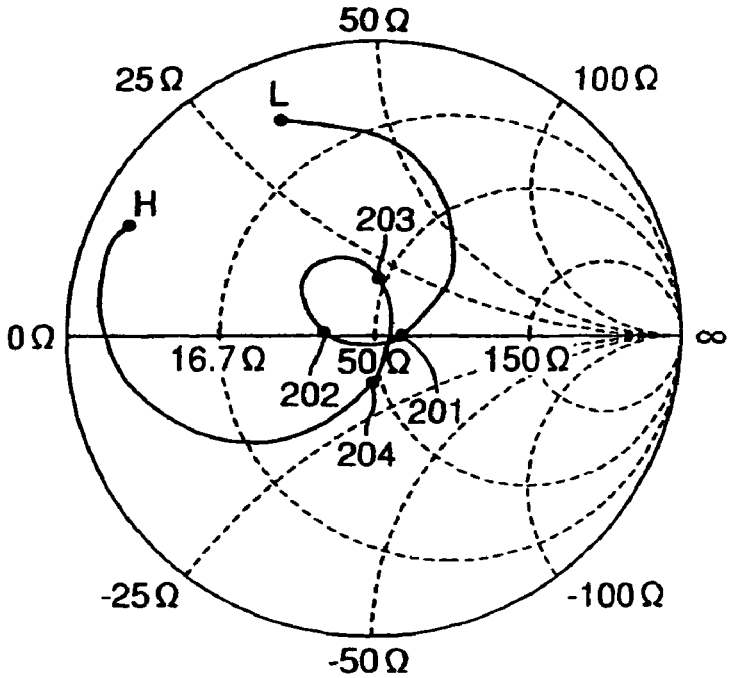
FIG. 8 is a Smith chart illustrating characteristics of the conventional antenna device.
Figure 9:
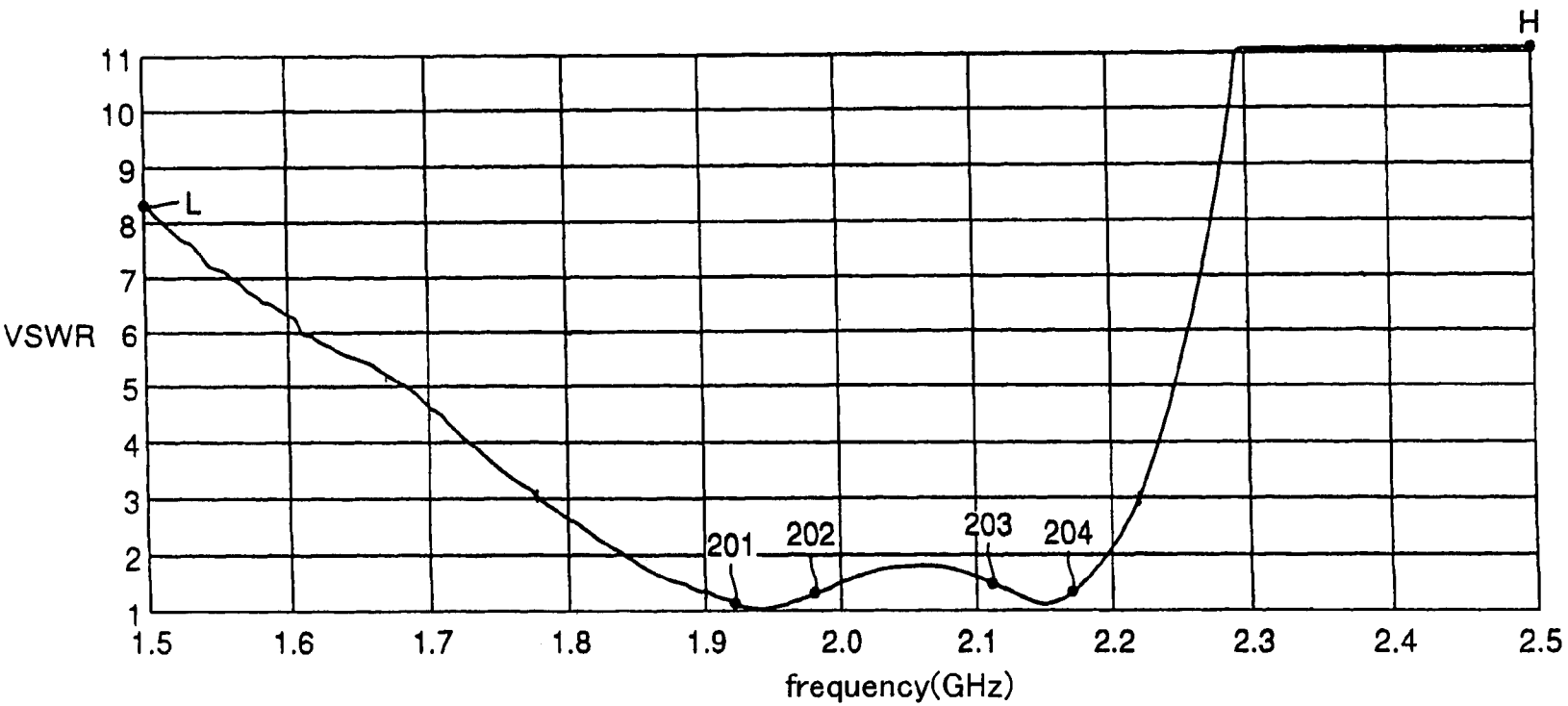
FIG. 9 is a VSWR chart illustrating characteristics of the conventional antenna device.

Moreover, FIG. 8 is a Smith chart illustrating characteristics of a conventional antenna device, FIG. 9 is its VSWR diagram. According to the Smith chart illustrated in FIG. 8, in the conventional antenna device, the reflection coefficients in the high and the low frequency regions turn out to be large. On the contrary, as pointed by point 201–point 204, in the frequency range from 1.9 GHz to 2.2 GHz, the reflection coefficients turn out to be smaller.

In addition, according to FIG. 9, VSWR is three or less than three in the frequency region from 1.78 GHz to 2.22 GHz. Moreover, in this region the relative band width is approximately 22%.

As a result, in the antenna device according to Embodiment 1 of the present invention, comparing with the conventional antenna device, it is found that broadening the band not only in the 2 GHz band (relative band width: 69%) but also near 800 MHz (relative band width: 32%) have been attained.

The mechanism has not yet been theoretically clarified, in which broad band characteristics and multiple resonance characteristics are obtained by making the feeding point out of one point on the plate antenna, and by connecting a plurality of monopole and linear antennas, each having its own predetermined electrical length, to the plate antenna, as in Embodiment 1 of the present invention; however, this is experimentally true, and the repeatability has also been confirmed.

Figure 10:
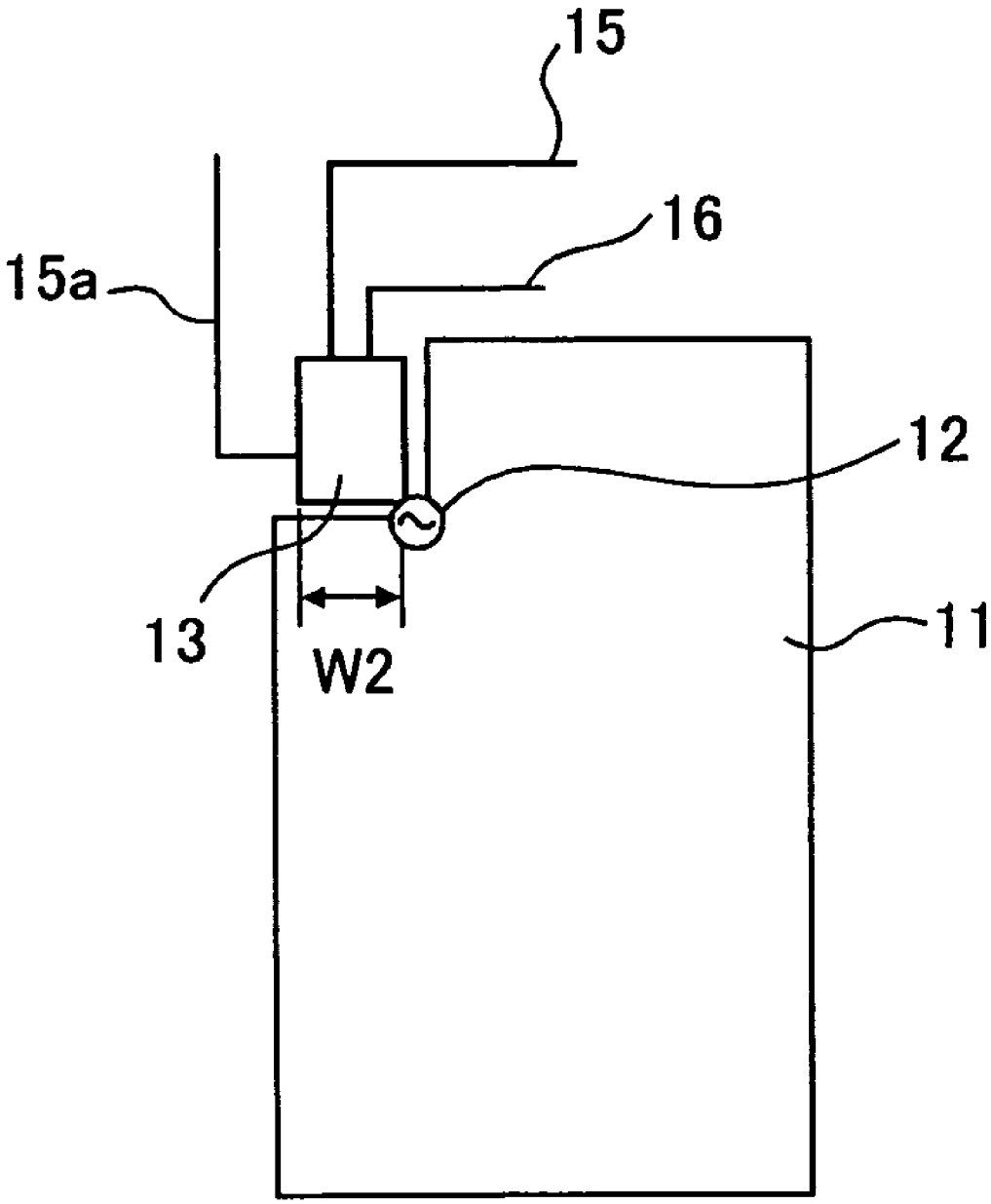
FIG. 10 is a plan view illustrating another configuration of the antenna device according to Embodiment 1 of the present invention.

Here, the feeding point can be located anywhere along the perimeter portion of the plate antenna without giving a significant effect to the characteristics. Moreover, regarding the positions of the monopole antenna 14*a* and linear antennas 15 and 16, although they are connected to the same end for the purpose of saving space, as illustrated in FIG. 1, it doesn't cause any problem in the characteristics even if the antenna is configured such that they are disposed on different ends. For example, the antenna may be configured in such a way that a linear antenna 15*a*, instead of the monopole antenna 14*a*, may be connected with the plate antenna 13 so that the linear antenna outwardly protrudes from a side face on the main case of the portable telephone, as illustrated in FIG. 10. In addition, although the monopole antenna 14*a* and the linear antennas 15 and 16 each are used for receiving different frequencies, the more apart the antennas are placed from each other, the less becomes interference between them. Moreover, the more apart the antennas are placed from the grounding plate 11, the more excellent characteristics can be empirically obtained. The grounding plate 11 may be configured of only its perimeter portion in which the inner portion has been cut away.

As described above, in Embodiment 1 of the present invention, one point on the plate antenna is set as a feeding point; then a monopole and linear antennas, which have each predetermined electrical length, are connected with the plate antenna so that they are connected in series with respect to the feeding point, enabling each antenna to be fed from the feeding point; consequently, the antenna device having broad band characteristics and multiple resonance characteristics can be obtained.

Embodiment 2

Figure 11:
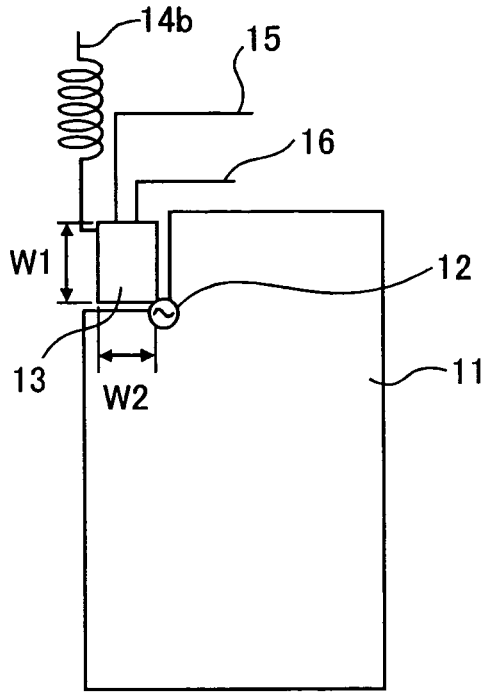
FIG. 11 is a plan view illustrating an antenna device according to Embodiment 2 of the present invention.
Figure 12:
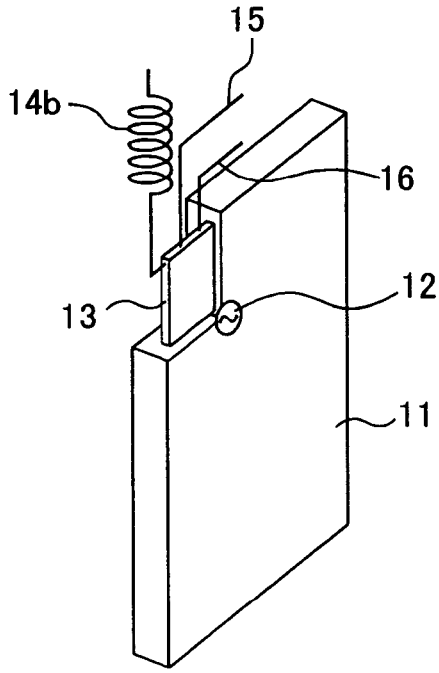
FIG. 12 is a perspective view illustrating the antenna device according to Embodiment 2 of the present invention.

Next, Embodiment 2 of the present invention will be explained. FIG. 11 is a plan view illustrating a configuration of an antenna device according to Embodiment 2 of the present invention, and FIG. 12 is its perspective view. As illustrated in FIG. 11 and FIG. 12, the difference from Embodiment 1 is that a helical antenna 14*b* is provided instead of the monopole antenna. Other antennas such as the plate antenna 13 and the linear antennas 15 and 16 are the same as those in Embodiment 1.

In the helical antenna 14*b*, the electrical length, which is the sum of the electrical length of the helical antenna itself and the electrical length of the plate antenna 13, is approximately $\lambda_{800}/4$ in the 800 MHz band. An antenna device configured such as this has a similar effect to the antenna device illustrated in FIG. 1.

Figure 13:
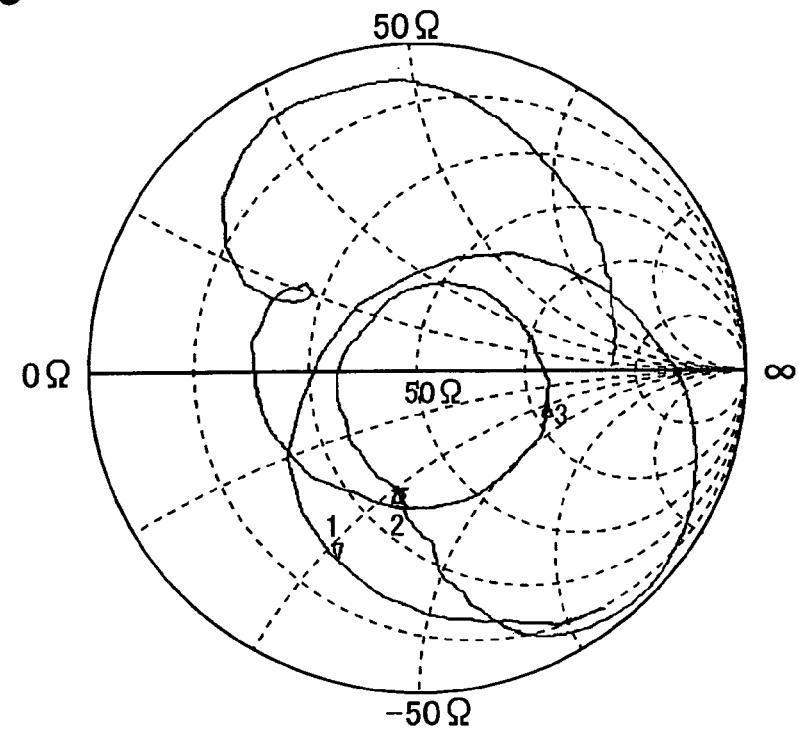
FIG. 13 is a Smith chart illustrating characteristics of the antenna device according to Embodiment 2 of the present invention.
Figure 14:
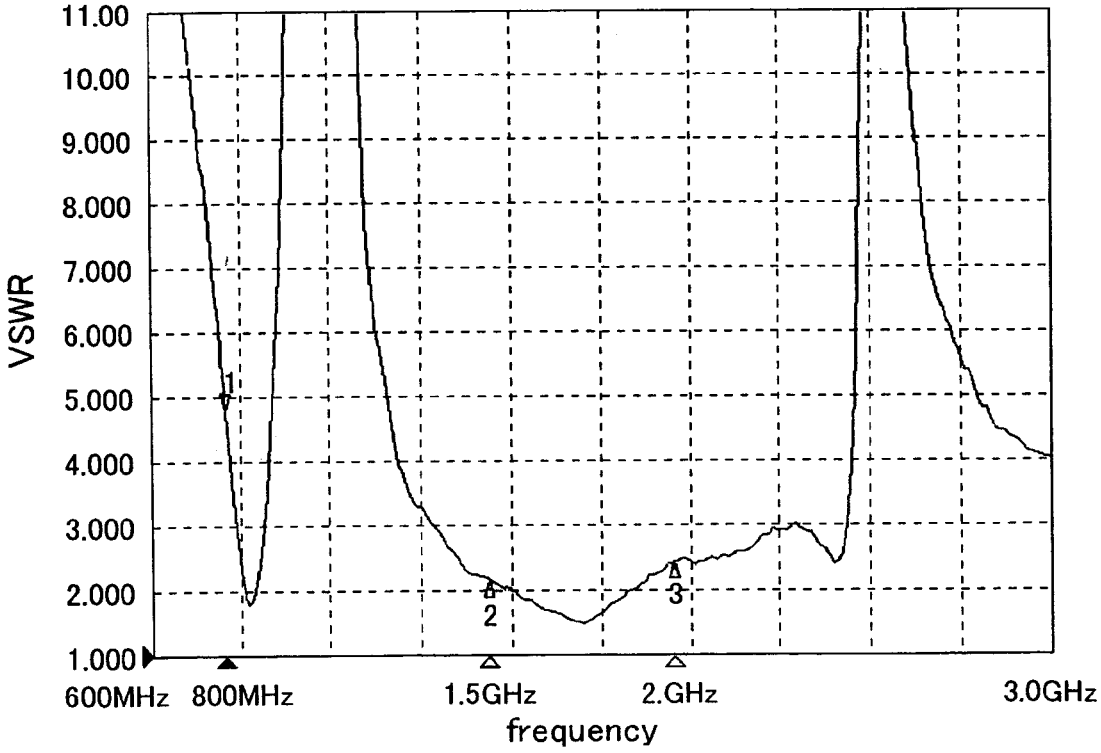
FIG. 14 is a VSWR chart illustrating characteristics of the antenna device according to Embodiment 2 of the present invention.

FIG. 13 is a Smith chart illustrating the antenna characteristics of the antenna device according to Embodiment 2, and FIG. 14 is its VSWR view. As illustrated in FIG. 13, the impedance locus aggregates in the proximity of the center point of 50 Ω, owing to the interaction among each of the antennas, such as the plate antenna 13, the helical antenna 14*b*, and the linear antennas 15 and 16; as a result, the impedance turns out to be matched in a broader band.

Here, similarly to Embodiment 1, details of the interaction among the antennas have not yet been theoretically clarified; however, the repeatability has experimentally been confirmed.

Moreover, the feeding point can be located anywhere along the perimeter portion of the plate antenna, which does not give any significant effect to the characteristics. Regarding the position of the helical antenna 14*b* and linear antennas 15 and 16, although they are connected to the same end for the purpose of saving space, as illustrated in FIG. 8, it doesn't cause any problem in the characteristics even if the antenna is configured such that they are placed on different ends. In addition, although the helical antenna 14*b* and the linear antennas 15 and 16 each are used for receiving different frequencies, the more apart the antennas are located from each other, the less the mutual interference becomes. Moreover, the more apart the antennas are located from the grounding plate 11, the more excellent characteristics can be empirically obtained. The grounding plate 11 may be configured of only its perimeter portion in which the inner portion has been cut away.

The impedance and VSWR at predetermined frequencies are listed in Table 3.

TABLE 3

| | | Impedance of antenna device [Ω] | | |
|---|---|---|---|---|
| Point | Frequency [MHz] | Real part [Ω] | Imaginary part [Ω] | VSWR |
| 1 | 800 | 15.107 | −30.817 | 4.758 |
| 2 | 1500 | 33.949 | −28.624 | 2.154 |
| 3 | 2000 | 112.37 | −25.873 | 2.425 |

The obtained relative band width in FIG. 14 is 56% in the 1.5 GHz 2 GHz band; consequently, broadening the band can be found to have been realized, comparing the band with that of the conventional antenna device. Moreover, although VSWR at 800 MHz is three or more than three, a band in which VSWR is three or less than three is found to have arisen in the proximity of the higher frequency side than 800 MHz, as illustrated in FIG. 14.

As described above, in Embodiment 2 of the present invention, a helical and plural linear antennas, each of which has its own predetermined electrical length, are connected with a plate antenna, which is connected with a grounding plate via a single feeding point, in series with respect to the feeding point so that each antenna has a common feeding point; consequently, the antenna device having broad band characteristics and multiple resonance characteristics can be obtained.

INDUSTRIAL APPLICABILITY

An antenna device according to the present invention can be utilized in the field of, for example, portable information terminals such as a portable telephone, general use wireless equipment, and special use wireless equipment.

What is claimed is:

1. An antenna device comprising:

a plate antenna formed of a metal plate having a predetermined electrical length and connected via a feeding point thereof with a grounding plate;

a monopole antenna having an electrical length different from the electrical length of the plate antenna and being connected with the plate antenna; and a plurality of linear antennas connected with the plate antenna and each having an electrical length different from the other and different from both the electrical length of the plate antenna and the monopole antenna.

2. An antenna device as set forth in claim 1, wherein:

the electrical length of the plate antenna is approximately one-eighth of a wavelength in the 2 GHz band;

the sum of the electrical lengths of the monopole antenna and the plate antenna is approximately one-quarter of a wavelength in the 800 MHz band; and the sum of the electrical length of a first of the linear antennas and the electrical length of the plate antenna is approximately one-quarter of a wavelength in the 1.5 GHz band, and the sum of the electrical length of a second of the linear antennas and the electrical length of the plate antenna is approximately one-quarter of a wavelength in the 2.0 GHz band.

3. An antenna device as set forth in claim 2, wherein:

the plate antenna has a square form, and its feeding point is in the proximity of one of the vertexes of the square; and the monopole antenna and the first and second linear antennas are connected onto an end of the plate antenna across from said one of the vertexes.

4. An antenna device comprising:

a plate antenna formed of a metal plate having a predetermined electrical length and connected via a feeding point thereof with a grounding plate;

a helical antenna having an electrical length different from the electrical length of the plate antenna and being connected with the plate antenna; and a plurality of linear antennas connected with the plate antenna and each having an electrical length different from the other and different from both the electrical length of the plate antenna and the helical antenna.

5. An antenna device as set forth in claim 4, wherein:

the electrical length of the plate antenna is approximately one-eighth of a wavelength in the 2 GHz band;

the sum of the electrical lengths of the helical antenna and the plate antenna is approximately one-quarter of a wavelength in the 800 MHz band; and the sum of the electrical length of a first of the linear antennas and the electrical length of the plate antenna is approximately one-quarter of a wavelength in the 1.5 GHz band, and the sum of the electrical length of a second of the linear antennas and the electrical length of the plate antenna is approximately one-quarter of a wavelength in the 2.0 GHz band.

6. An antenna device as set forth in claim 5, wherein:

the plate antenna has a square form, and its feeding point is in the proximity of one of the vertexes of the square; and the helical antenna and the first and second linear antennas are connected onto a side of the plate antenna across from said one of the vertexes.

7. A portable telephone including an antenna device, the antenna device comprising:

a plate antenna formed of a metal plate having a predetermined electrical length and connected via a feeding point thereof with a grounding plate;

a monopole antenna having an electrical length different from the electrical length of the plate antenna and being connected with the plate antenna; and a plurality of linear antennas connected with the plate antenna and each having an electrical length different from the other and different from both the electrical length of the plate antenna and the monopole antenna.

8. A portable telephone as set forth in claim 7 provided with a helical antenna instead of the monopole antenna.

* * * * *